US008259963B2

(12) United States Patent
Stenberg et al.

(10) Patent No.: US 8,259,963 B2
(45) Date of Patent: Sep. 4, 2012

(54) MICROPHONE ASSEMBLY WITH P-TYPE PREAMPLIFIER INPUT STAGE

(75) Inventors: Lars Jorn Stenberg, Roskilde (DK); Carsten Fallesen, Nyborg (DK)

(73) Assignee: Sonion A/S, Roskilde (DK)

( * ) Notice: Subject to any disclaimer, the term of this patent is extended or adjusted under 35 U.S.C. 154(b) by 1338 days.

(21) Appl. No.: 11/481,632

(22) Filed: Jul. 6, 2006

(65) Prior Publication Data

US 2007/0009111 A1 Jan. 11, 2007

Related U.S. Application Data

(60) Provisional application No. 60/696,910, filed on Jul. 6, 2005.

(51) Int. Cl.
*H04R 3/00* (2006.01)

(52) U.S. Cl. ..... 381/113; 381/120

(58) Field of Classification Search ..... 381/111, 381/113, 120, 312; 330/277
See application file for complete search history.

(56) References Cited

U.S. PATENT DOCUMENTS

| | | | | |
|---|---|---|---|---|
| 4,491,697 | A | 1/1985 | Tanaka et al. | 179/111 |
| 4,922,471 | A | 5/1990 | Kuehnel | 367/181 |
| 4,993,072 | A | 2/1991 | Murphy | 381/113 |
| 5,097,224 | A | 3/1992 | Madaffari et al. | 330/277 |
| 5,490,220 | A * | 2/1996 | Loeppert | 381/113 |
| 5,710,519 | A * | 1/1998 | McCalpin et al. | 327/538 |
| 2002/0125949 | A1 * | 9/2002 | Stenberg | 381/111 |

FOREIGN PATENT DOCUMENTS

| | | |
|---|---|---|
| EP | 0969695 | 1/2000 |
| EP | 1355416 A1 | 10/2003 |
| EP | 1 388 895 A2 | 2/2004 |

OTHER PUBLICATIONS

European Search Report, 7 pages, (May 12, 2010).
Korean Office Action in Application No. 10-2006-0063540, dated Jun. 22, 2012, (4 pages).

* cited by examiner

*Primary Examiner* — Ping Lee
(74) *Attorney, Agent, or Firm* — Nixon Peabody LLP

(57) ABSTRACT

A microphone assembly is provided that includes a condenser transducer element having a displaceable diaphragm and a back-plate. The displaceable diaphragm and the back-plate are arranged to form a capacitor in combination. A preamplifier circuit has an input stage, the input stage comprising a P-type field effect transistor. The displaceable diaphragm and the back-plate are operatively connected between a source input and a gate input of the P-type field effect transistor.

20 Claims, 3 Drawing Sheets

MICROPHONE ASSEMBLY WITH P-TYPE PREAMPLIFIER INPUT STAGE

CROSS-REFERENCE TO RELATED APPLICATIONS

This application claims priority to, and hereby incorporates by reference, U.S. Provisional Application No. 60/696,910, entitled "Microphone Assembly With P-Type Preamplifier Input Stage," filed Jul. 6, 2005 with the United States Patent and Trademark Office.

FIELD OF THE INVENTION

The present invention relates to a microphone assembly comprising a condenser transducer element having a diaphragm, a back-plate and a preamplifier circuit that has an input stage with a P-type field effect transistor. The diaphragm and back-plate are operatively connected between the source input of the P-type field effect transistor and the gate input of the P-type field effect transistor, so that input-referred noise is low and noise induced from the supply line is significantly attenuated as improved power supply rejection is obtained.

BACKGROUND OF THE INVENTION

Various microphone assemblies in the art disclose how a diaphragm and a back-plate of a condenser transducer element can be coupled to an input stage of a preamplifier having a P-type field effect transistor. Examples of such references are EP 0969695 A1 and EP 1355416 A1.

In both EP 0969695 A1 and EP 1355416 A1, the respective diaphragms and the back-plates are coupled to the respective P-type field effect transistors between respective gate inputs of the transistors and ground. A disadvantage of this coupling or electrical interface is that noise applied or injected at the source input is amplified because ground acts as a signal reference terminal. The amplification of noise introduces unwanted disturbances in the desired audio signal provided by the condenser transducer element.

Thus, there is a need for an improved electrical coupling between a condenser transducer element and a P-type field effect transistor.

SUMMARY OF THE INVENTION

One of the objects of an embodiment of the present invention is to provide a microphone assembly where a diaphragm and a back-plate are electrically coupled to a P-type field effect transistor in such a manner that electronic noise on the power supply line is effectively attenuated. In view of this object, an embodiment of the present invention relates to a microphone assembly having an advantageous electrical interface or coupling between diaphragm and back-plate terminals of transducer element and input terminals (nodes) of a microphone preamplifier.

According to an embodiment of the invention, a microphone assembly is provided that comprises a condenser transducer element having a displaceable diaphragm and a back-plate. The displaceable diaphragm and the back-plate may be arranged to form a capacitor in combination. A preamplifier circuit may have an input stage, the input stage comprising a P-type field effect transistor. The displaceable diaphragm and the back-plate may be operatively connected between a source input and a gate input of the P-type field effect transistor.

According to another embodiment of the invention, a method of processing an electrical signal from a condenser transducer element having a displaceable diaphragm and a back-plate is provided. The method comprises the steps of providing the condenser transducer element with the displaceable diaphragm operatively connected to a source input of a P-type field effect transistor. The condenser transducer element is provided with the back-plate operatively connected to a gate input of the P-type field effect transistor. An electrical signal provided at the drain output of the P-type field effect transistor is processed.

An embodiment of the present invention may be applied within the area of silicon condenser microphones but the invention will also be beneficial in connection with optimally interfacing a condenser transducer element to a preamplifier in traditional condenser microphones such as electret microphones and their associated preamplifiers.

There are many advantages afforded by embodiments of the present invention. For example, electronic input referred noise of the preamplifier may be minimized by using a P-type field effect input transistor and by improving power supply noise rejection of the microphone assembly. Another advantage is the reduction of light induced noise in certain silicon microphone assemblies. Experimental results indicate a noise reduction in the order of 20-30 dB has been achieved.

Thus, in order to comply with the above-mentioned objects, the present invention relates, in a first aspect, to a microphone assembly having a condenser transducer element comprising a displaceable diaphragm and a back-plate. The displaceable diaphragm and the back-plate are arranged to form a capacitor in combination. A preamplifier circuit is included that has an input stage with a P-type field effect transistor. The displaceable diaphragm and the back-plate are operatively connected between a source input and a gate input of the P-type field effect transistor.

The diaphragm is "displaceable" because it is capable of and adapted to deflect relative to the back-plate upon exposure to sound pressure. Thus, when the condenser transducer element is exposed to sound pressure the displaceable diaphragm deflects such that the instantaneous distance between the displaceable diaphragm and the back-plate changes in accordance with the amplitude of the sound pressure.

The displaceable diaphragm and the back-plate may be operatively connected between the source input and the gate input of the P-type field effect transistor by operatively connecting the displaceable diaphragm to the source input of the P-type field effect transistor, and operatively connecting the back-plate to the gate input of the P-type field effect transistor. When the condenser transducer element is exposed to sound pressure, a capacitance of the capacitor or condenser formed by the diaphragm and back-plate in combination varies in accordance with the amplitude of the applied sound pressure. The varying capacitance is thus a measure of the detected sound pressure. The detected sound pressure can be detected by the preamplifier in that the varying capacitance induces a corresponding, essentially proportional, signal voltage across the capacitor plates because electrical charges on the diaphragm and back-plate are kept substantially constant by ensuring that only electrical connections with ultra high impedances are provided to the capacitor.

The condenser transducer element may include an electret transducer element type comprising an electrically pre-charged layer of material providing a build-in or permanent electrical field between the diaphragm and the back-plate. The permanent electrical field may be provided by an electrically pre-charged layer, such as a Teflon coating with implanted electrical charges, arranged on either the diaphragm or back-plate. The condenser transducer element may alternatively be of the type requiring an external high impedance bias voltage source for generating an electrical field between the diaphragm and the back-plate. Such an external high impedance bias voltage source may comprise a Dickson voltage pump followed by a smoothing type of filter, such as a low pass filter. The external high impedance bias voltage source is preferably arranged inside a common housing with the condenser transducer element to avoid EMI problems that could be associated with long leads between the bias voltage source and the condenser transducer element.

The P-type field effect transistor may be of the type JFET, MOS or similar field effect polysilicon-insulator semiconductor transistor. The condenser transducer element may comprise a MEMS fabricated transducer, such as a silicon-based MEMS transducer where the diaphragm, back-plate and bulk material each include a silicon material.

In order to establish DC blocking between the back-plate and the gate of the P-type field effect transistor, a capacitor is usually inserted between the back-plate and the gate input of the P-type field effect transistor. However, a DC blocking capacitor may not be required or needed in electret condenser transducer elements.

The microphone assembly may advantageously include a bias voltage source for electrically biasing the back-plate relative to the displaceable diaphragm. The bias voltage source may provide a DC voltage of 5 to 20 volts, or more preferably between 8 and 12 volts between the back-plate and the displaceable diaphragm of a silicon-based transducer. This bias voltage may be lower or higher in other types of transducer elements. Thus, other voltage levels, including negative voltage levels, may also be applied between the back-plate and the displaceable diaphragm. The bias voltage source may be operatively connected to the back-plate via a high impedance element, such as an ohmic resistor having a resistance of some hundreds of Giga Ohms or even Tera Ohms. Alternatively, one or more reverse biased semiconductor diodes may be utilized.

Preferably, the condenser transducer element is a silicon-based condenser transducer element with an external DC bias voltage source. Silicon-based condenser transducer elements, where the diaphragm or the back-plate is directly exposed to the environment, tend to be sensitive to light exposure in that electronic noise is superimposed onto the output signal from such transducers. The origin of this light induced noise is believed to be due to the semiconductor properties and thereby the semiconductor behavior of silicon. However, by grounding or virtually grounding the diaphragm in transducer elements having the diaphragm physically facing the environment and where the diaphragm essentially overlaps the back-plate area, the electrically conductive diaphragm will act as an EMI shield so that problems relating to light-induced noise in silicon-based transducers can be significantly reduced.

The condenser transducer element may further include a bulk part. The bulk part may be operatively connected to the diaphragm, or it may be operatively connected to ground.

In a second aspect, the present invention relates to a portable communication device that includes a microphone assembly according to the first aspect of the present invention. The portable communication device may be a cell phone, a hearing aid, a PDA or any combination thereof.

In a third aspect, the present invention relates to a method of processing an electrical signal from a condenser transducer element having a displaceable diaphragm and a back-plate. The method includes providing the condenser transducer element with the displaceable diaphragm operatively connected to a source input of a P-type field effect transistor. The condenser transducer element is provided with the back-plate operatively connected to a gate input of the P-type field effect transistor. An electrical signal provided at the drain output of the P-type field effect transistor is processed.

In a fourth aspect, the present invention relates to an integrated semiconductor circuit comprising a preamplifier circuit having an input stage which comprises a P-type field effect transistor. The preamplifier comprises a first externally accessible input terminal operatively connected to a source input of the P-type field effect transistor and a second externally accessible input terminal operatively connected to a gate input of the P-type field effect transistor. The first and second input terminals are operatively connectable to a displaceable diaphragm and a back-plate, respectively, of a condenser transducer element. Alternatively, the first and second input terminals may be operatively connectable in opposite order to the displaceable diaphragm and a back-plate.

According to a preferred embodiment of this aspect of the present invention, the integrated semiconductor circuit comprises a DC blocking element inserted between the second externally accessible input terminal and the gate input of the P-type field effect transistor. The integrated semiconductor circuit may further comprise a microphone bias voltage source adapted to provide a microphone DC bias voltage to the second externally accessible input terminal. The second externally accessible input terminal is therefore adapted to provide a microphone DC bias voltage for one of the displaceable diaphragm and the back-plate. This microphone DC bias voltage is preferably set to value between 5 and 20 volts for MEMS-based condenser microphones.

In a preferred embodiment of the invention, the integrated semiconductor circuit comprises a voltage regulator adapted to provide a regulated DC voltage that is operatively coupled to the source input of the P-type field effect transistor. The regulated DC voltage is preferably set to a value between 0.9 and 5.0 volts. The DC voltage difference between the microphone DC bias voltage and the regulated DC voltage is preferably set to a value between 4.0 and 20.0 volts.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

In the following, preferred embodiments of the invention will be described with reference to the drawing, wherein.

Figure 1:
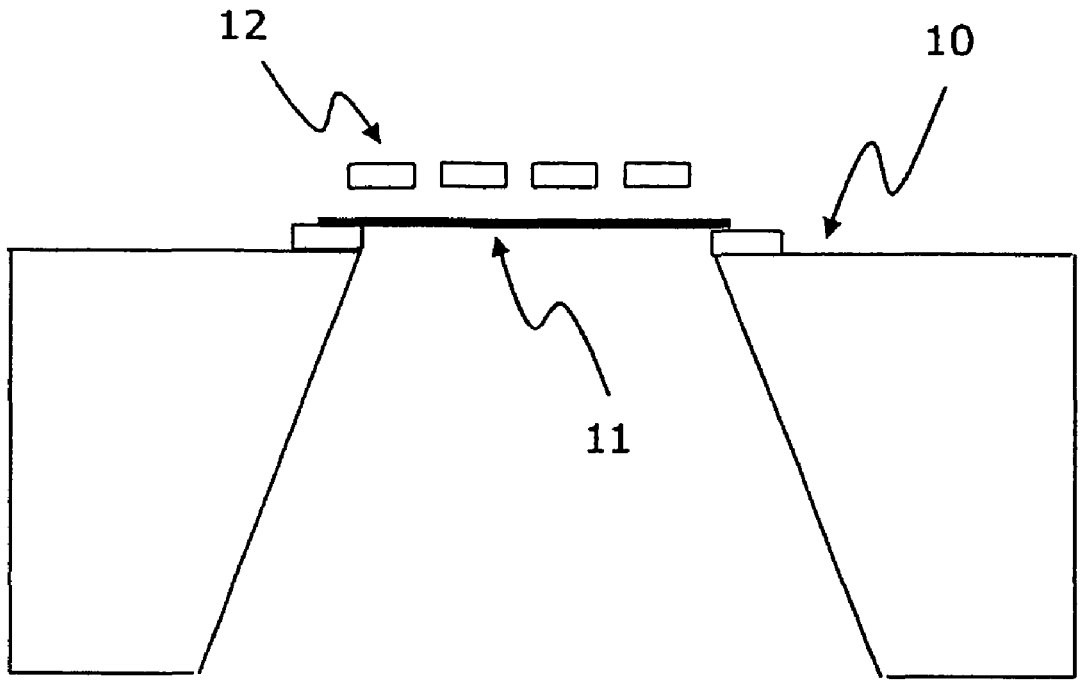
FIG. 1 shows the arrangement of diaphragm, back-plate and bulk in a silicon microphone.

While the invention is susceptible to various modifications and alternative forms, specific embodiments have been shown by way of example in the drawings and will be described in detail herein. It should be understood, however, that the invention is not intended to be limited to the particular forms disclosed. Instead, the invention is to cover all modifications, equivalents, and alternatives falling within the spirit and scope of the invention as defined by the appended claims.

DETAILED DESCRIPTION

In its most general aspect, an embodiment of the present invention relates to a microphone assembly having a transducer element with a diaphragm and a back-plate forming a capacitor in combination. A preamplifier has an input stage comprising a P-type field effect transistor. The source and gate terminals of the P-type field effect transistor act as differential input terminals. The drain terminal acts as output terminal. This configuration reduces the influence of noise present on the source terminal because such supply noise is commonly applied by the nature of the configuration to both source and gate of the P-type field effect transistor. Accordingly, the supply noise acts as a common mode signal. This implies that noise on the supply signal will not be amplified by the input stage of the preamplifier.

This embodiment of the invention also ensures optimal reduction of bulk and diaphragm noise sources in a silicon-based microphone as illustrated in FIG. 1. In FIG. 1, the diaphragm 11 is placed in between the back-plate 12 and the bulk 10 of the silicon condenser microphone. The diaphragm 11 may be highly electrically conductive to allow it to electrically shield the bulk of the microphone from significant capacitive coupling to the back-plate.

The diaphragm 11 is connected to a low impedance power supply node, i.e. a virtual ground node, of the input stage of the succeeding preamplifier while the back-plate is connected to a high impedance DC bias voltage source 1 and 2. The back-plate 12 is preferably coupled to the input of the succeeding preamplifier through a DC voltage blocking element such as a capacitor because the back-plate 12 is held at the DC voltage potential of the bias voltage source.

Figure 2:
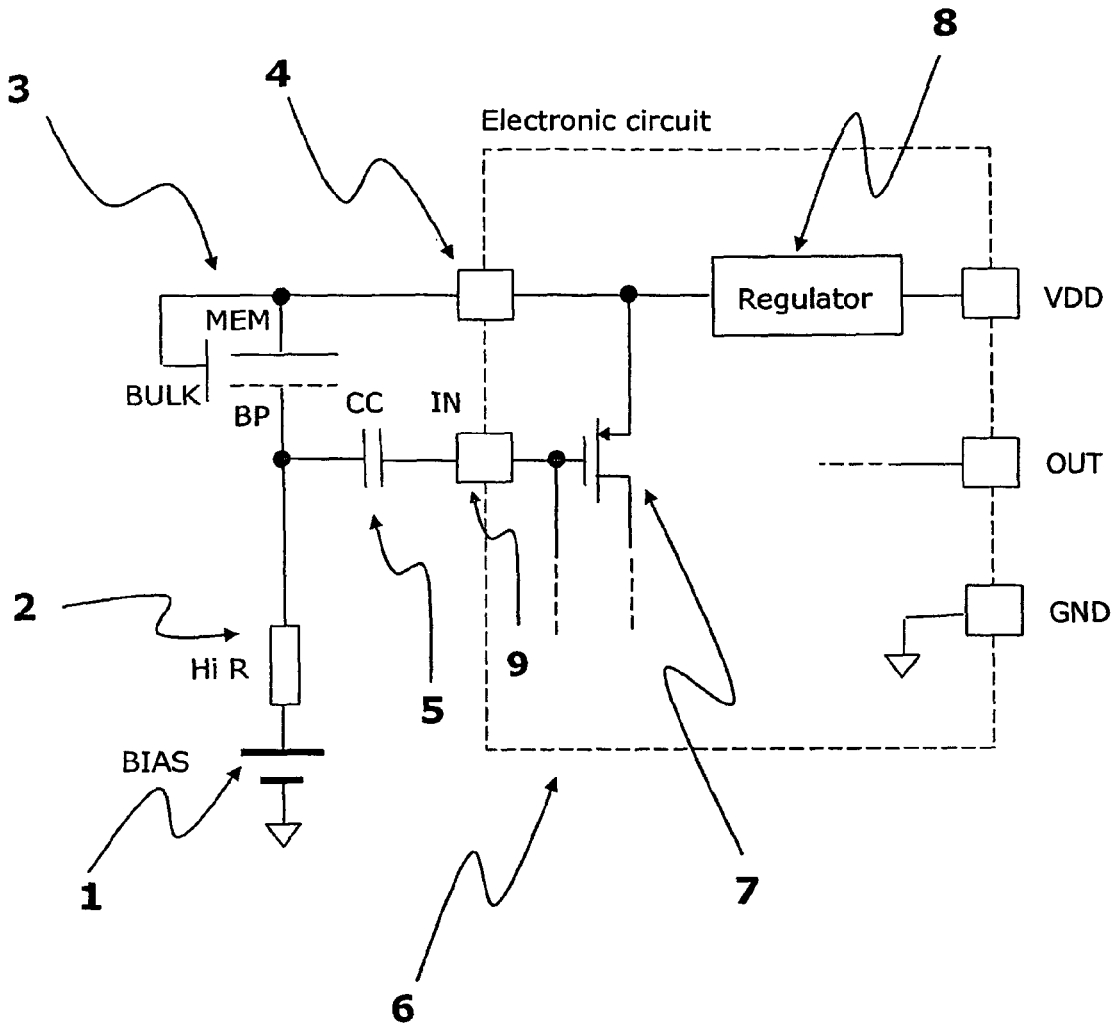
FIG. 2 illustrates a silicon microphone assembly according to an embodiment of the present invention.

FIG. 2 illustrates a silicon microphone assembly according to one embodiment of the invention. A high impedance bias voltage source for a condenser transducer element 3 is depicted in its simplest form and denoted 1. The high impedance bias voltage source 1 includes an ultra high ohmic series resistance element 2. to ensure charge conservation of the condenser transducer element 3. The exact physical implementation of the bias voltage source may vary from the simplified schematic depicted in FIG. 2. According to a preferred embodiment of the invention, the high impedance bias voltage source includes a Dickson voltage multiplier based on reverse-biased diodes or diode-connected transistors.

A pair of parallel diodes in reverse polarity (not shown in FIG. 2) may be inserted between the gate input of the P-type field effect transistor and ground or another suitable reference voltage. Such a pair of parallel diodes ensures an input impedance higher than 100 GΩ of the input stage of the preamplifier. In fact, a pair of parallel diodes in reverse polarity may have an impedance of several TΩ. In case the preamplifier is to be integrated in an ASIC, the pair of parallel diodes coupled in reverse polarity may advantageously be integrated therewith.

The back-plate 12 of the condenser transducer element 3 is electrically connected to the bias circuit resistor element 2 and furthermore electrically connected to the input node IN of the preamplifier through a DC blocking capacitor 5. The diaphragm and usually also the bulk node 10 of the condenser transducer element 3 are connected to the low impedance voltage supply node 4 of the succeeding preamplifier circuit.

The input stage of the preamplifier includes a P-type field effect transistor, preferably a PMOS transistor 7, which references the voltage supply node 4. The voltage supply node 4 may be derived directly from the external power supply voltage VDD of the microphone assembly, or alternatively, it may be derived by regulating and stabilizing the external supply voltage VDD by a regulator circuit 8. The regulator circuit 8 provides the low output impedance required for coupling to the PMOS transistor 7 amplifying element.

The back-plate terminal 9 and the diaphragm terminal 4 (also called voltage node) of the condenser transducer element 3 are referenced to the same node as the input stage of the preamplifier. Supply noise on the voltage supply node 4 is significantly attenuated because any signal on 4 will commonly be applied to the gate input of the PMOS transistor 7 of the microphone preamplifier and therefore not amplified. Furthermore, the input stage comprises a P-type field effect transistor, preferably a PMOS transistor 7, which has superior flicker noise properties compared to a NMOS transistor. For this reason, both white noise and flicker noise of the input stage are reduced to a minimum. The PMOS transistor 7 preferably has a width (W) between 100 and 1000 μm and a length between 0.5 and 5 μm. The DC bias current is preferably set to a value between 10 μA and 100 μA for microphone assemblies targeted for battery-powered portable communication devices but other DC bias current values may be selected in other types of applications. The semiconductor process is preferably a 0.18 μm or 0.35 μm minimum feature size 3M CMOS process suitable for mixed-signal circuits.

According to some embodiments of the present invention, the condenser transducer element 3 includes a silicon-based transducer element where the diaphragm (MEM) is placed between the bulk (BULK) and the back-plate (BP) of the condenser transducer element 3. In such embodiments, external noise signals such as intensity varying light impinging on the diaphragm (MEM), or noise signals generated in the bulk of the microphone, are attenuated by the connection to the low impedance voltage supply node 4.

Figure 3:
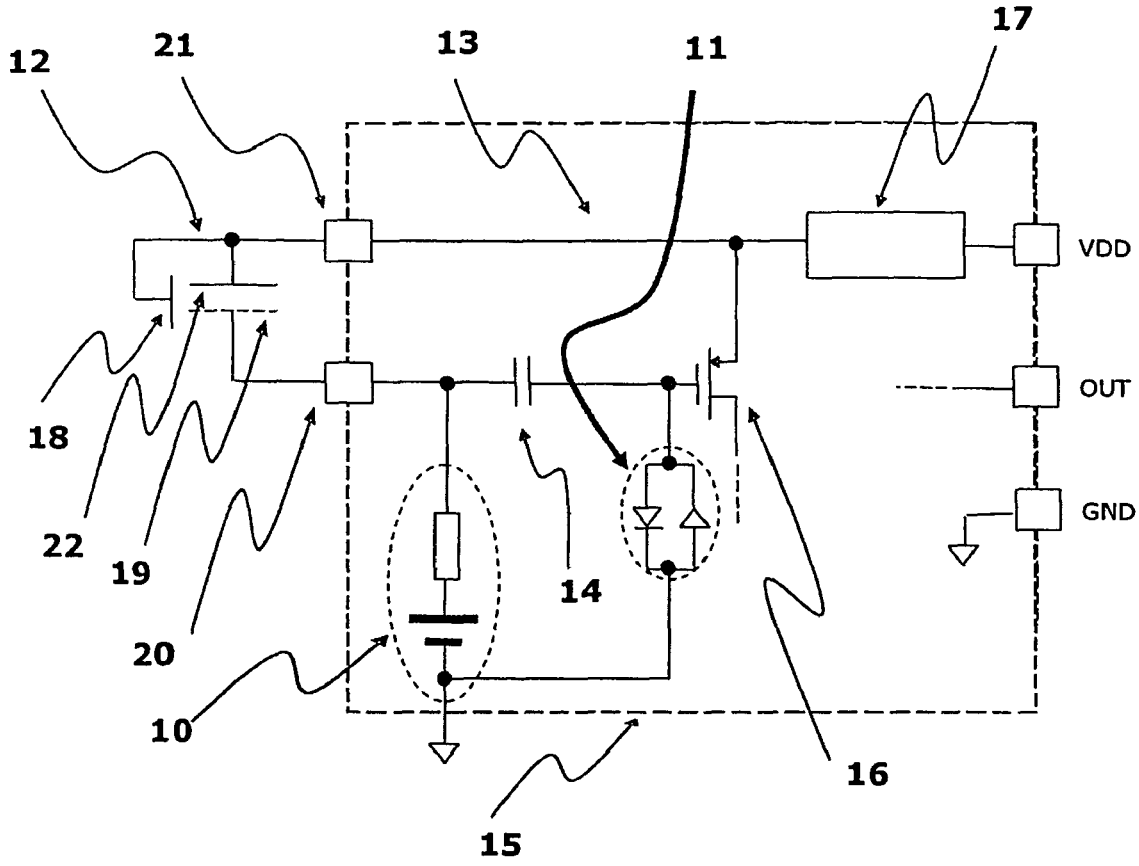
FIG. 3 illustrates a silicon microphone assembly according to another embodiment of the present invention.

FIG. 3 illustrates a silicon microphone assembly according to another embodiment of the present invention. A high impedance DC bias voltage source 10 for a condenser transducer element 12 and a DC blocking capacitor 14 are, contrary to the architecture of the first embodiment of FIG. 2, both integrated on the electronic or integrated semiconductor circuit die 15 together with an input stage PMOS transistor 16 and an optional voltage regulator 17. The high impedance DC bias voltage source 10 is shown schematically as a cascade of a DC bias voltage generator and a large series resistor. The high impedance DC bias voltage source 10 may comprise a voltage pump or multiplier, such as Dickson voltage multiplier, utilizing a supply voltage (VDD) of the integrated circuit 15 to generate a multiplied higher DC voltage. In one embodiment of the invention, a nominal supply voltage of 1.8 volt is multiplied to generate a high impedance DC bias voltage of about 8 volts.

A first externally accessible terminal 20 and a second externally accessible terminal 21 are operatively coupled to the gate and source inputs, respectively, of PMOS transistor 16. The first externally accessible terminal 20 is furthermore coupled to high impedance DC bias voltage source 10 to allow this externally accessible terminal to be electrically coupled to a back-plate 19 or a diaphragm 22 of an associated condenser transducer element 12. The gate input of the PMOS transistor 16 is electrically shielded from the DC bias voltage provided on the first externally accessible terminal 20 by the DC blocking capacitor 14 to allow setting the DC bias point of the PMOS transistor 16 through an independent bias setting network 11 comprising a pair of reverse biased diodes, i.e. similar to the network described in connection with the first embodiment of the invention.

Each of these embodiments and obvious variations thereof is contemplated as falling within the spirit and scope of the claimed invention, which is set forth in the following claims.

The invention claimed is:

1. A microphone assembly comprising:

a condenser transducer element having a displaceable diaphragm and a back-plate, the displaceable diaphragm and the back-plate being arranged to form a capacitor in combination;

a preamplifier circuit having an input stage comprising a P-type field effect transistor; and a microphone bias voltage source adapted to provide a DC bias voltage between the back-plate and the displaceable diaphragm, the microphone bias voltage source being integrated on an electronic or integrated semiconductor circuit die together with the input stage P-type field effect transistor;

wherein the displaceable diaphragm and the back-plate are operatively connected between a source input and a gate input of the P-type field effect transistor, the back-plate being operatively connected to the gate input, and the displaceable diaphragm being operatively connected to the source input; and the displaceable diaphragm and the source input are configured to be referenced to an external power supply voltage.

2. A microphone assembly according to claim 1, wherein each of the back-plate and the gate input of the P-type field effect transistor is operatively connected via a DC voltage blocking element.

3. A microphone assembly according to claim 2, wherein the DC voltage blocking element comprises a capacitor.

4. A microphone assembly according to claim 1, wherein the microphone bias voltage source is operatively connected to the back-plate via a high impedance element having a resistance larger than 10 Giga Ohms.

5. A microphone assembly according to claim 4, wherein the high impedance element is selected from the group consisting of a resistor and a reverse biased semiconductor diode.

6. A microphone assembly according to claim 1, wherein the condenser transducer element comprises a MEMS-based transducer.

7. A microphone assembly according to claim 1, wherein the P-type field effect transistor is selected from the transistor group consisting of: JFET and MOS transistors.

8. A microphone assembly according to claim 1, wherein the condenser transducer element further comprises a bulk part operatively connected to the displaceable diaphragm.

9. A microphone assembly according to claim 1, wherein the condenser transducer element further comprises a bulk part operatively connected to ground.

10. A microphone assembly according to claim 1, wherein the back-plate or the displaceable diaphragm is provided with a permanent electrically pre-charged layer.

11. A portable communication device comprising the microphone assembly according to claim 1.

12. A portable communication device according to claim 11, wherein the portable communication device is selected from the group consisting of a cell phone, a hearing aid, a PDA, and any combination thereof.

13. A method of processing an electrical signal from a condenser transducer element having a displaceable diaphragm and a back-plate, the method comprising the steps of:

providing the condenser transducer element with the displaceable diaphragm operatively connected to a source input of a P-type field effect transistor;

providing a DC bias voltage to the back-plate by a microphone bias voltage source being integrated on an electronic or integrated semiconductor circuit die together with the input stage P-type field effect transistor;

providing an external supply voltage to the displaceable diaphragm and the source input;

providing the condenser transducer element with the back-plate operatively connected to a gate input of the P-type field effect transistor; and processing an electrical signal provided at the drain output of the P-type field effect transistor.

14. A method according to claim 13, wherein each of the back-plate and the gate input of the P-type field effect transistor is operatively connected via a DC voltage blocking element.

15. A method according to claim 14, wherein the DC voltage blocking element comprises a capacitor.

16. An integrated semiconductor circuit comprising:

a preamplifier circuit having an input stage comprising a P-type field effect transistor, the preamplifier circuit comprising a first externally accessible input terminal operatively connected to a source input of the P-type field effect transistor and a second externally accessible input terminal operatively connected to a gate input of the P-type field effect transistor; and a microphone bias voltage source adapted to provide a DC bias voltage to the second externally accessible input terminal so as to provide a DC bias voltage for one of the displaceable diaphragm and the back-plate, the microphone bias voltage source being integrated on an electronic or integrated semiconductor circuit die together with the input stage P-type field effect transistor, wherein the first and second input terminals are operatively connectable to an associated displaceable diaphragm and an associated back-plate, respectively, of a condenser transducer element, the back-plate being operatively connected to the gate input of the P-type field effect transistor, and the displaceable diaphragm being operatively connected to the source input of the P-type field effect transistor; and the displaceable diaphragm and the source input are configured to be referenced to an external power supply voltage.

17. An integrated semiconductor circuit according to claim 16, further comprising a DC blocking element inserted between the second externally accessible input terminal and the gate input of the P-type field effect transistor.

18. An integrated semiconductor circuit according to claim 16, further comprising voltage a regulator providing a regulated DC voltage, the voltage regulator being operatively coupled to the source input of the P-type field effect transistor.

19. An integrated semiconductor circuit according to claim 18, wherein the regulated DC voltage is set to a value between 0.9 volts and 5.0 volts.

20. An integrated semiconductor circuit according to claim 19, wherein a DC voltage difference between the DC bias voltage and the regulated DC voltage is set to a value between 4.0 volts and 20.0 volts.

* * * * *